United States Patent [19]

Andersson et al.

[11] 4,081,038

[45] Mar. 28, 1978

[54] HAND HELD IMPACT DEVICE

[75] Inventors: Sture R. Andersson, Saltsjo-Duvnas; Jarl J. Blomberg, Nacka; Heino Elmessaar, Lidingo, all of Sweden

[73] Assignee: Atlas Copco Aktiebolag, Nacka, Sweden

[21] Appl. No.: 676,750

[22] Filed: Apr. 14, 1976

[30] Foreign Application Priority Data

Apr. 22, 1975 Sweden ..... 046276

[51] Int. Cl.[2] ..... E21B 3/00

[52] U.S. Cl. ..... 173/162; 16/116 R; 279/1 Q

[58] Field of Search ..... 16/116 R; 74/18.2; 173/162, DIG. 2; 181/33 K, 36 A; 279/1 B, 1 Q, 19.4, 19.6, 22; 145/61 M, 78

[56] References Cited

U.S. PATENT DOCUMENTS

| | | | |
|---|---|---|---|
| 712,438 | 10/1902 | Shaw | 279/19.4 X |
| 1,325,982 | 12/1919 | Dougherty | 279/19.6 |
| 1,362,657 | 12/1920 | Whyte | 173/162 X |
| 1,656,450 | 1/1928 | Steuer | 279/22 |
| 2,088,670 | 8/1937 | Smith | 279/19.6 X |
| 2,122,517 | 7/1938 | Curtis | 181/36 A UX |
| 2,154,651 | 4/1939 | Wodack et al. | 279/19.6 |
| 2,561,726 | 7/1951 | Cherain | 173/DIG. 2 |
| 2,685,874 | 8/1954 | Ford | 145/78 X |
| 2,999,407 | 9/1961 | DeFrangesco | 279/19.5 X |
| 3,202,239 | 8/1965 | Clarke | 181/36 A UX |
| 3,379,278 | 4/1968 | Skowron | 181/36 A UX |
| 3,525,531 | 8/1970 | Ekstrom et al. | 279/19.6 |
| 3,757,891 | 9/1973 | Krieger | 173/DIG. 2 |
| 3,910,590 | 10/1975 | Ekstrom | 279/1 Q X |
| 3,916,478 | 11/1975 | Shotwell | 279/1 Q X |
| 3,920,086 | 11/1975 | Goppen et al. | 173/162 |

FOREIGN PATENT DOCUMENTS

| | | | |
|---|---|---|---|
| 77,382 | 5/1933 | Sweden | 173/DIG. 2 |

*Primary Examiner*—Lawrence J. Staab
*Attorney, Agent, or Firm*—Flynn & Frishauf

[57] ABSTRACT

A hand held impact device comprising a housing and an impact mechanism located therein. The housing is provided with an opening at its front end through which opening a working tool is introducable to receive impacts from the impact mechanism. A maneuver handle for direct, manual guidance of the working tool is freely displaceable along the working tool shank and is formed with a rear annular recess for being attachable to a cylindrical neck portion on the housing. The neck portion is coaxial with the working tool opening and forms a coupling means for the maneuver handle. The neck portion is provided with a groove with which spring biased balls on the maneuver handle are arranged to cooperate in order to releasably retain the maneuver handle in its supported position on the housing. The maneuver handle comprises a steel socket and a rubber sleeve which extends ahead of the steel socket to form a resilient, vibration insulating grip element.

11 Claims, 3 Drawing Figures

HAND HELD IMPACT DEVICE

This invention relates to a hand held impact device of the type comprising a housing in which there is located an impact mechanism and which housing is provided with a front opening for receiving the shank of a working tool.

Particularly, the invention relates to a hand held impact device in which the operator holds and guides by hand the working tool, for instance a chisel hammer.

When working with such machines the operator is exposed to serious, unhealthy, vibrations, especially in the hand by which he holds and guides the working tool.

According to previous attempts to solve this problem the shank of the working tool has been provided with different types of vibration insulating means. These have been unsatisfactory in that they have not been able to be promptly secured relative to the tool, and because they have caused functional problems. Moreover, these previous devices have offered a very limited protection against vibrations and they have resulted in increased working tool costs.

The present invention intends to solve the above problems in such a way that the drawbacks of the previous solutions are avoided. This is obtained by a device according to the invention as defined by the claims.

BRIEF DESCRIPTION OF THE DRAWINGS

An embodiment of the invention is hereinbelow described in detail with references to the drawing, in which.

DETAILED DESCRIPTION

Figure 1:
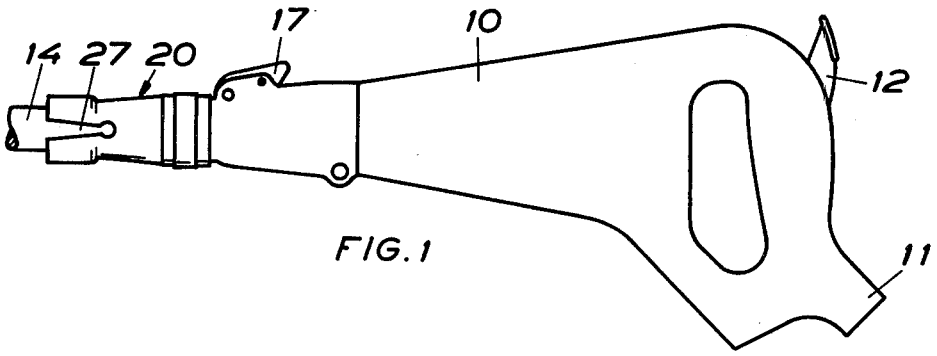
FIG. 1 shows a side elevation of a pneumatic chisel hammer according to the invention.

The impact device shown in the drawing comprises a housing 10 in which there is located a pneumatic impact mechanism (not shown) which is supplied with pressure air through a conduit connection 11 and a control valve. The latter is operated by means of a lever 12. Moreover, the housing 10 is provided with an opening 13 (FIG. 2) at its front end through which opening the shank of a working tool 14 is introducable to receive impacts from the impact mechanism.

Figure 2:
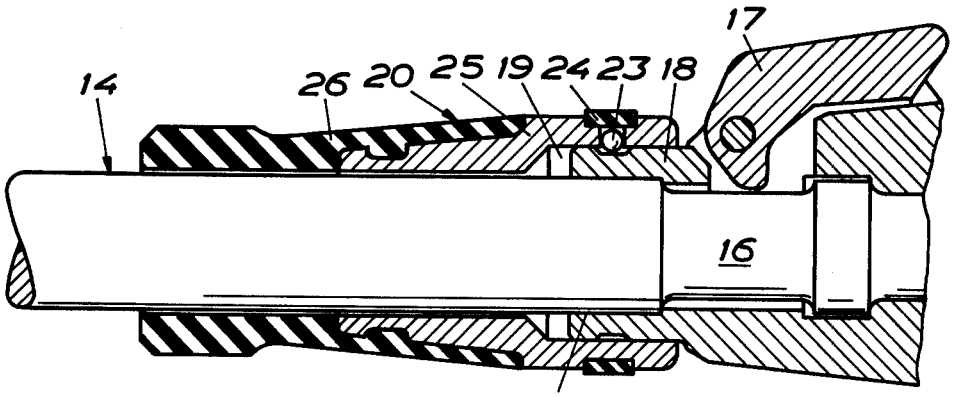
FIG. 2 shows, in larger scale, a longitudinal section through the impact device according to FIG. 1.

As shown in FIG. 2, the working tool 14 is formed with a waist 16, and a pivotable retaining means 17 on the housing 10 is arranged to cooperate with the waist 16 in order to retain the working tool 14 in its introduced position.

Figure 3:
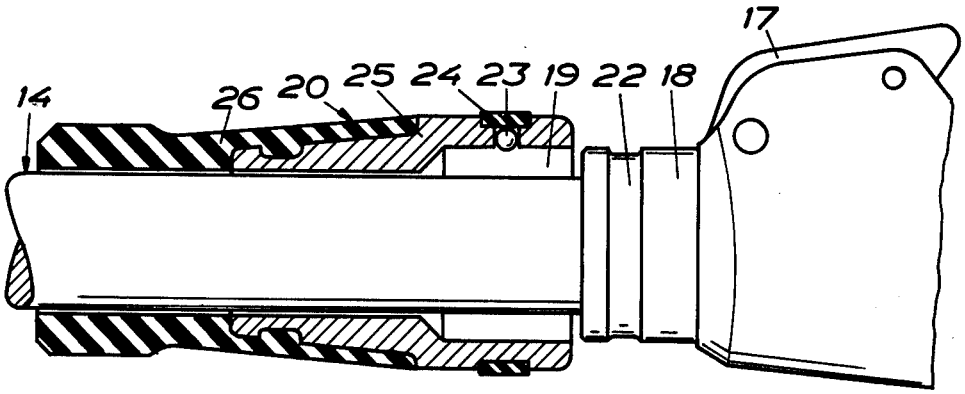
FIG. 3 shows in the same way a side elevation partly in section of the impact device in FIG. 1 but shows the maneuver handle in its released position.

As seen in FIGS. 2 and 3, around the working tool opening 13 the housing 10 is formed with a cylindrical neck portion 18. Upon this neck portion 18 the housing 10 is arranged to releasably support a maneuver handle 20 which is intended for direct manual guidance of the working tool 14. For cooperation with the neck portion 18 of the housing 10 the maneuver handle 20 is provided with a matching cylindrical recess 19. The neck portion 18 constitutes a coupling means for interconnection with the maneuver handle 20.

Moreover, the housing 10 and the maneuver handle 20 are provided with a retaining means for releasably retaining the maneuver handle 20 relative to the neck portion 18, e.g. when changing working tool or when the machine is not in operation. This retaining means comprises an annular groove 22 on the neck portion 18 and a number of spring biased balls 23 carried by the maneuver handle 20. The balls 23 are spring biased radially inwardly by means of a rubber band 24 and establish in their cooperation with the groove 22 a releasable snap coupling between the maneuver handle 20 and the housing 10. See FIG. 2.

The maneuver handle 20 comprises a rigid socket 25, for instance made of steel, and a vibration insulating element in the form of a rubber sleeve 26. These two parts are kept together in that the rubber sleeve 26 is passed onto and partly surrounds the socket 25. Thereby, the maneuver handle 10 is given an outwardly soft grip surface which is effective to insulate the operator from the vibrations in the working tool.

The maneuver handle 20 is intended to be used as a tool guide in its release position as well as in its housing supported position. When a very short working tool is used it is necessary to have the maneuver handle coupled to a machine housing. Though the handle 20 is attached to the housing the working tool is still able to be manually guided in that the forward part of the maneuver handle 20 is resilient and easily deflectable by hand. When using longer working tools the maneuver handle 20 is released from the neck portion 18 and is moved along the working tool until a convenient operating position is obtained. In order to obtain such movability it is of great importance that the internal diameter of the maneuver handle exceeds the diameter of the working tool so that a clearance therebetween is left.

For making it possible to turn the working tool by means of the maneuver handle 20 the operator may compress the forward portion of the rubber sleeve 26 so that a friction grip is obtained between the sleeve 20 and the working tool 14. The rubber sleeve 20 is formed with a longitudinal slot 27 in its forward end to facilitate such compression. See FIG. 1.

The invention is not limited to the shown and described embodiments but can be freely varied within the scope of the claims.

What is claimed is:

1. A hand held impact device comprising:

a housing having an impact mechanism located therein, a front opening for receiving the shank of a working tool, and a working tool retaining means, a sleeve shaped maneuver handle for receiving the working tool shank therethrough for manual guidance of the working tool, said sleeve shaped maneuver handle having an internal diameter at least as large as the diameter of said tool shank opening of said housing and larger than the diameter of the working tool shank passing therethrough, and being freely manually displaceable along the shank of the working tool during working, and releasable coupling means selectively coupling said maneuver handle to said housing such that said housing releasably supports said maneuver handle in coaxial relationship with said tool shank opening with said tool shank passing through said sleeve shaped maneuver handle, said sleeve shaped maneuver handle comprising a flexible portion extending ahead of said releasable coupling means in the working direction and which is manually compressible into contact with the working took shank, said flexible portion comprising at least one vibration insulating element for insulating an operator from vibrations of the working tool.

2. An impact device according to claim 1, wherein said releasable coupling means comprises:

a cylindrical neck portion of said housing coaxially surrounding said tool shank opening, a rear cylindrical recess in said maneuver handle matching said neck portion for receiving said neck portion therein, and retaining means for releasably retaining said maneuver handle relative to said neck portion.

3. An impact device according to claim 2, wherein said retaining means comprises an annular groove on said neck portion, and a number of spring biased balls carried by said maneuver handle, said balls being arranged to engage said annular groove as the maneuver handle is supported by said neck portion, thereby forming a snap coupling.

4. An impact device according to claim 2, wherein said maneuver handle comprises a cylindrical socket member which forms said cylindrical recess, and said flexible portion comprises a resilient sleeve which, at least partly, surrounds said socket member, said resilient sleeve comprising said at least one vibration insulating element.

5. An impact device according to claim 4, wherein said resilient sleeve extends ahead of said socket member in the working direction and is manually compressible for providing a friction grip between said sleeve and the working tool shank.

6. An impact device according to claim 5, wherein said extending portion of said resilient sleeve has a longitudinally directed slot therein to facilitate compression thereof.

7. An impact device according to claim 3, wherein said spring biased balls are carried by the portion of said maneuver handle defining said rear cylindrical recess.

8. An impact device according to claim 7, comprising at least one opening in said portion of said maneuver handle defining said rear cylindrical recess for receiving said balls therein, and a rubber band means over said at least one opening for biasing said balls toward said annular groove.

9. An impact device according to claim 3, wherein said maneuver handle comprises a cylindrical socket member which forms said cylindrical recess, and said flexible portion comprises a resilient sleeve which, at least partly, surrounds said socket member, said resilient sleeve comprising said at least one vibration insulating element.

10. An impact device according to claim 9, wherein said resilient sleeve extends ahead of said socket member in the working direction and is manually compressible for providing friction grip between said sleeve and the working tool shank.

11. An impact device according to claim 10, wherein said extending portion of said resilient sleeve has a longitudinally directed slot therein to facilitate compression thereof.

* * * * *